US012447369B2

(12) United States Patent
Byun

(10) Patent No.: US 12,447,369 B2
(45) Date of Patent: Oct. 21, 2025

(54) SPORTING APPARATUS WITH VARIABLE LOAD MODULE

(71) Applicant: NEWTECH WELLNESS CORPORATION, Gimhae-si (KR)

(72) Inventor: Hyun Jung Byun, Busan (KR)

(73) Assignee: NEWTECH WELLNESS CORPORATION, Gimhae-si (KR)

( * ) Notice: Subject to any disclaimer, the term of this patent is extended or adjusted under 35 U.S.C. 154(b) by 61 days.

(21) Appl. No.: 18/611,851

(22) Filed: Mar. 21, 2024

(65) Prior Publication Data

US 2024/0416167 A1 Dec. 19, 2024

(30) Foreign Application Priority Data

Jun. 16, 2023 (KR) ..... 10-2023-0077668

(51) Int. Cl.
*A63B 21/00* (2006.01)

(52) U.S. Cl.
CPC ..... *A63B 21/00069* (2013.01); *A63B 21/151* (2013.01); *A63B 2208/0233* (2013.01); *A63B 2225/093* (2013.01)

(58) Field of Classification Search
CPC ..... A63B 21/00069; A63B 21/151; A63B 21/152; A63B 21/156; A63B 21/159; A63B 2208/0233
See application file for complete search history.

(56) References Cited

U.S. PATENT DOCUMENTS 4,890,830 A * 1/1990 Kern ..... A63B 21/4047 482/137
5,018,725 A * 5/1991 Cook ..... A63B 21/4035 482/142
5,263,914 A * 11/1993 Simonson ..... A63B 23/0405 482/99
5,336,150 A * 8/1994 Mueller ..... A63B 21/00072 482/137
5,549,530 A * 8/1996 Fulks ..... A63B 23/1209 482/142
6,652,426 B2 * 11/2003 Carter ..... A63B 21/154 482/100

FOREIGN PATENT DOCUMENTS

KR 10-2294781 B1 8/2021

* cited by examiner

*Primary Examiner* — Zachary T Moore
(74) *Attorney, Agent, or Firm* — Revolution IP, PLLC

(57) ABSTRACT

An exercise equipment with a variable load module includes a seating portion providing a space for a user to sit; an external force application portion disposed adjacent to the seating portion and including the rotating bar that rotates about a main rotating axis and a grip portion that is formed on the rotating bar and provides a space for a user to grip; a load application portion disposed at the rear of the seating portion, including a plurality of weights, and connected to the rotating bar with a cable to be raised and lowered according to the rotation of the rotating bar; and a variable load module connecting the rotating bar and the load application portion and allowing the position at which the cable is connected to the rotating bar to vary so that the load applied to the rotating bar changes.

4 Claims, 5 Drawing Sheets

(a)

(b)

SPORTING APPARATUS WITH VARIABLE LOAD MODULE

CROSS REFERENCE TO RELATED APPLICATIONS

This application claims priority to Korean Patent Application No. 10-2023-0077668 filed on Jun. 16, 2023, which is hereby incorporated by reference in its entirety.

BACKGROUND OF THE INVENTION

The present disclosure relates to exercise equipment with a variable load module, and, more particularly, to exercise equipment allowing a seated user to work out by pulling or pushing a rotating bar to lift a load.

In general, it is very important to exercise regularly in terms of improving muscle strength and endurance. However, people living in today's society find it difficult to exercise due to their busy lives, so most of them do not exercise enough.

Recently, the wellness boom has been growing rapidly, and the age at which adult diseases develop has gradually decreased due to the westernization of eating habits. As a result, awareness of the need for leisure activities and various indoor and outdoor exercises has increased throughout society.

In response to this overall social atmosphere, a range of sports facilities has been built at a rapid pace not only in large cities but also in small and medium-sized cities. In particular, gyms that are suitable for working out without being affected by weather or seasons have received a lot of attention.

This is because such gyms provide a space where users can do various aerobic exercises as well as muscular workouts on different body parts. Particularly, the reason why the gyms are popular among people who want to do muscular workouts is because they can appropriately change the load for muscular workouts (increase or decrease in a load) based on their physical condition or the amount of exercise.

In the case of conventional exercise equipment, the load for muscular workouts can be changed by changing the number of weights for applying the load. However, because the weight of the weights is not subdivided and the process of changing the number of weights is cumbersome, there has been a need for a way to change an exercise load more easily.

RELATED ART LITERATURE

Patent Literature (Patent Literature 1) Korean Patent No. 10-2294781

SUMMARY OF THE INVENTION

The present disclosure has been made in an effort to provide exercise equipment allowing a user to work out by pulling or pushing a rotating bar to lift a load.

The exercise equipment with a variable load module according to an embodiment of the present disclosure may allow a seated user to work out by pulling or pushing a rotating bar to lift a load and include: a seating portion providing a space for a user to sit; an external force application portion disposed adjacent to the seating portion and including the rotating bar that rotates about a main rotating axis and a grip portion that is formed on the rotating bar and provides a space for a user to grip; a load application portion disposed at the rear of the seating portion, including a plurality of weights, and connected to the rotating bar with a cable to be raised and lowered according to the rotation of the rotating bar; and a variable load module connecting the rotating bar and the load application portion and allowing the position at which the cable is connected to the rotating bar to vary so that the load applied to the rotating bar changes.

The variable load module of the exercise equipment with a variable load module according to an embodiment of the present disclosure may include: a mounting bar formed on the rotating bar, disposed adjacent to the grip portion, and forming a space for mounting in a height direction; a position moving portion connected to the mounting bar to slide in the height direction of the mounting bar; a fixing portion connected to the position moving portion, which limits the sliding of the position moving portion along the mounting bar by being fastened to the mounting bar or enables the position moving portion to slide along the mounting bar by being disengaged from the mounting bar; and a cable connection portion connected to the position moving portion and the cable. When the distance from the grip portion increases, the position moving portion may lengthen the vector path of a first external force applied to the grip portion to raise and lower the load application portion, thereby increasing the intensity of the first external force, and, when the distance from the grip portion decreases, the position moving portion may shorten the vector path of a second external force applied to the grip portion to raise and lower the load application portion, thereby reducing the intensity of the second external force.

The position moving portion of the exercise equipment with a variable load module according to an embodiment of the present disclosure may include: a sliding portion that has a shape corresponding to the outer peripheral surface of the mounting bar and surrounds the mounting bar; an intermediate connection portion fixed to and interlocked with the sliding portion; and a connection rotation axis connecting the intermediate connection portion and the cable connection portion and mounted rotatably on the intermediate connection portion to allow the cable connection portion to rotate against the intermediate connection portion. When the intermediate connection portion slides along the mounting bar, the connection rotation axis may be rotated by the load from the load application portion, preventing the cable from bending.

The intermediate connection portion of the exercise equipment with a variable load module according to an embodiment of the present disclosure may be in the shape of the Korean letter "ㄷ" the connection rotation axis may connect both ends of the intermediate connection portion and be arranged to be spaced apart from the sliding portion to secure a space where the cable connection portion can rotate; the mounting bar may have a plurality of through holes penetrating from one side thereof; the fixing portion may include a fixing body portion fixed to the intermediate connection portion and a fixing button portion that is moved by an applied external force while it is accommodated in the fixing body portion; when the fixing button portion is moved toward the mounting bar by an applied external force, it may be inserted into any one of the plurality of through holes, restricting the movement of the intermediate connection portion on the mounting bar; and when the fixing button portion is moved away from the mounting bar by an applied external force, it may be separated from the through hole into which it has been inserted, allowing the intermediate connection portion to freely move on the mounting bar.

The exercise equipment with a variable load module according to an embodiment of the present disclosure may further include: a standing portion standing up from the bottom surface and providing a space where the load application portion is accommodated; a base portion extending forward from the lower end of the standing portion to be seated on the bottom surface and providing a space where the main rotating axis is mounted; a space providing portion connected to the base portion, providing a space for the seating portion to be mounted, disposed at the rear of the seating portion, and including a backrest portion on which a user can lean back; and a frame portion including a footrest portion that extends from the front end of the base portion to provide a space for supporting feet of a user sitting on the seating portion. The rotating bar may include a first rotating bar disposed on one side of the seating portion and a second rotating bar disposed on the other side thereof, and the variable load module may include a first variable load module connected to the first rotating bar and a second variable load module connected to the second rotating bar.

According to the present disclosure, it may be possible to not only change an exercise load by changing the number of weights for applying the load, but also easily change an exercise load through a variable load module adjacent to a handle or a grip portion.

In addition, it may be possible to set loads that cannot be set by changing the number of weights, expanding a user's options for exercise loads.

Lastly, because the variable load module may be formed to be mounted on conventional exercise equipment, compatibility may be increased.

DETAILED DESCRIPTION OF THE INVENTION

Figure 1:
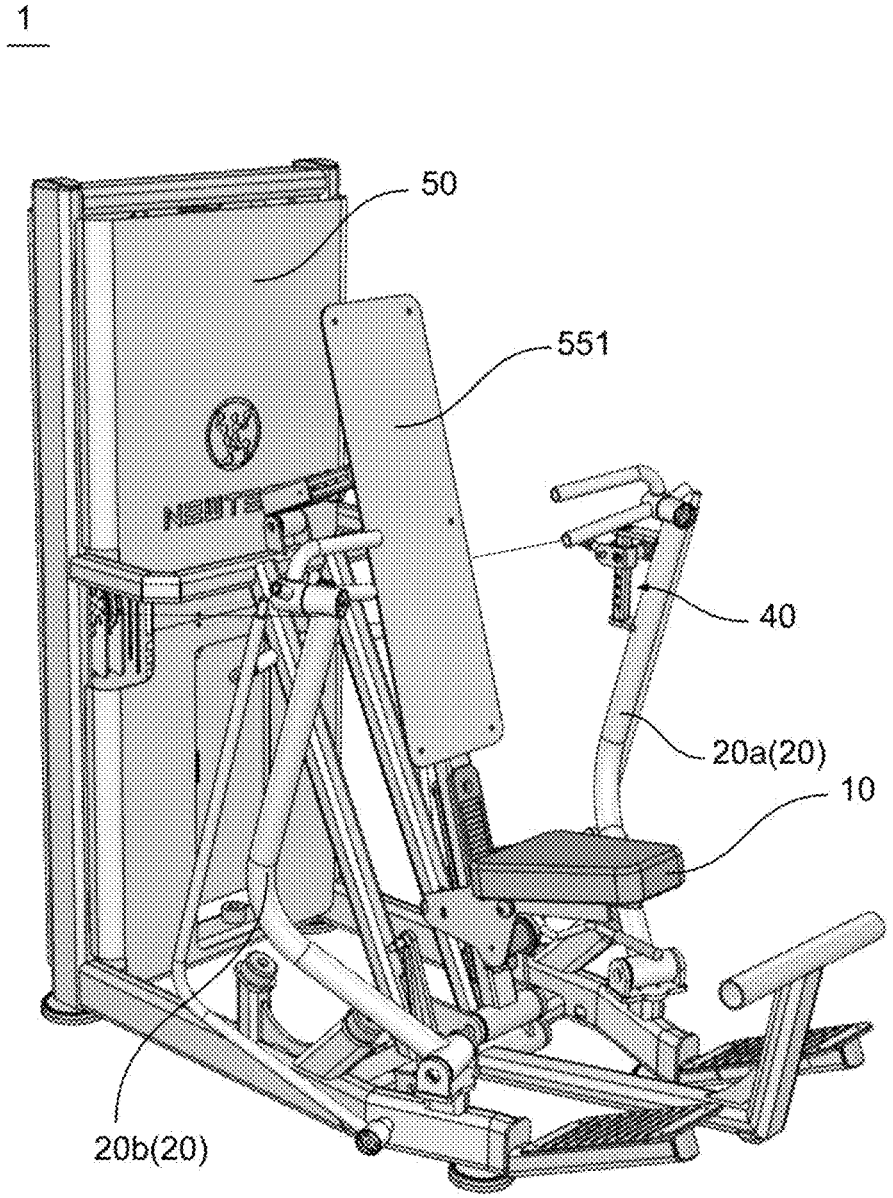
FIG. 1 is a perspective view schematically showing exercise equipment with a variable load module according to an embodiment of the present disclosure.

Hereinafter, the specific embodiments of the present disclosure will be described in detail with reference to the drawings. However, the technology of the present disclosure is not limited to the presented embodiments. A person having ordinary skill in the art who understands the technology of the present disclosure would be able to easily suggest other embodiments within the technology of other regressive disclosures or the present disclosure by adding, changing, or removing components within the technology of the present disclosure, but such embodiments can also be said to be within the technology of the present disclosure.

In addition, components with the same function within the same technology shown in the drawing of each embodiment will be described with the same drawing reference numeral.

Figure 2:
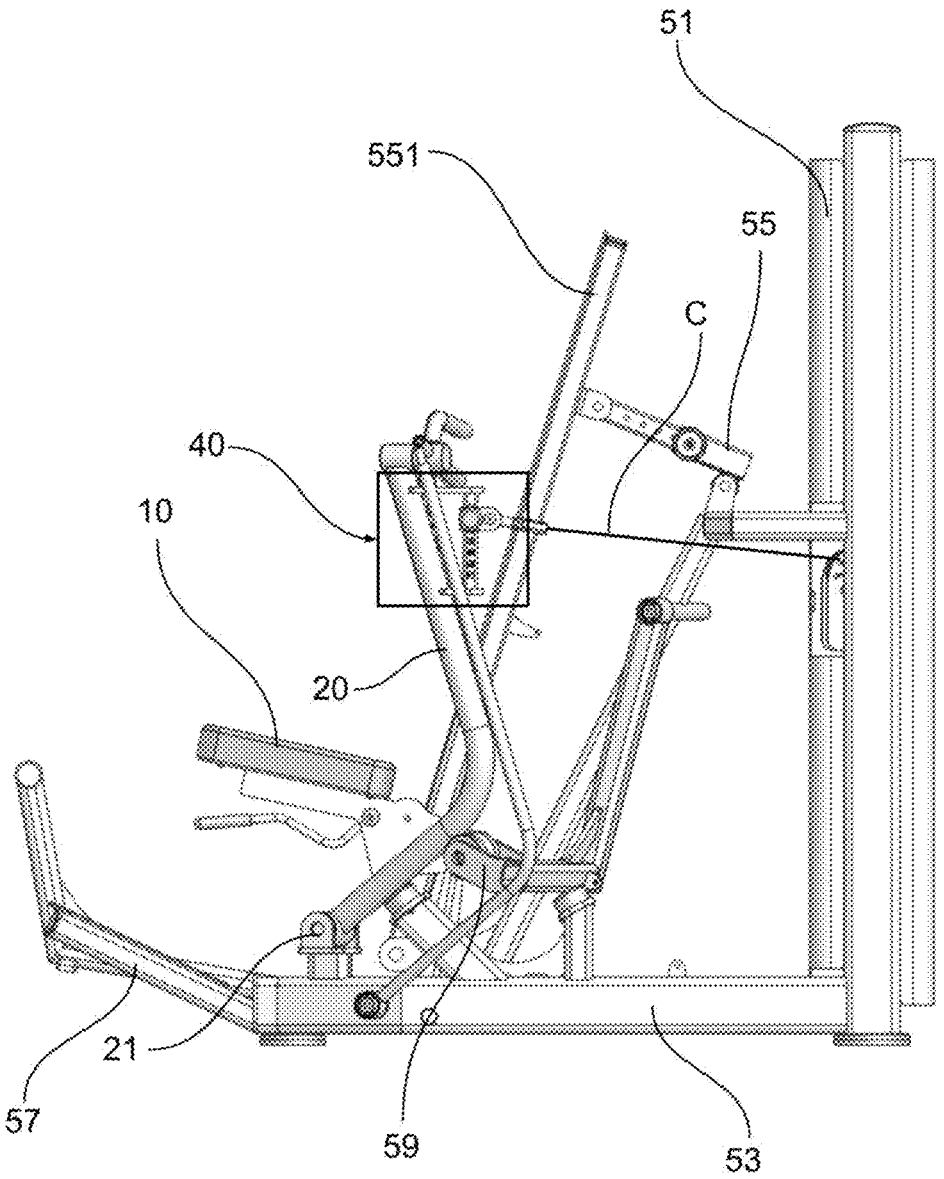
FIG. 2 is a side view schematically showing the exercise equipment with a variable load module according to an embodiment of the present disclosure.

FIG. 1 is a perspective view schematically showing exercise equipment with a variable load module according to an embodiment of the present disclosure, and FIG. 2 is a side view schematically showing the exercise equipment with a variable load module according to an embodiment of the present disclosure.

Referring to FIGS. 1 and 2, exercise equipment 1 with a variable load module 40 (hereinafter, referred to as "exercise equipment") according to an embodiment of the present disclosure may allow a seated user to work out by pulling or pushing a rotating bar 20 to lift a load.

The exercise equipment 1 according to an embodiment of the present disclosure may include a seating portion 10, an external force application portion, a load application portion 30, and the variable load module 40.

The seating portion 10 may provide a space for a user to sit.

The external force application portion may be disposed adjacent to the seating portion 10, and may include the rotating bar 20 that rotates about a main rotating axis 21 and a grip portion 23 formed on the rotating bar 20 and providing a space for a user to grip.

The load application portion 30 may be disposed at the rear of the seating portion 10, and may include a plurality of weights and be connected to the rotating bar 20 with a cable C to be raised and lowered according to the rotation of the rotating bar 20.

The variable load module 40 may connect the rotating bar 20 and the load application portion 30, and may allow the position at which the cable C is connected to the rotating bar 20 to vary, enabling the load applied to the rotating bar 20 to change.

Specifically, the variable load module 40 may change the distance between the grip portion 23 that a user grips and the cable C while maintaining the same load on the load application portion 30 so that the intensity of the external force to rotate the rotating part may change.

In order to change the amount of the load for rotating the rotating bar 20, a user may change the number of weights of the load application portion 30, or may operate the variable load module 40 while maintaining the same number of weights of the load application portion 30.

A detailed description of the variable load module 40 will be provided below with reference to FIG. 2.

The exercise equipment 1 according to an embodiment of the present disclosure may include a frame portion 50.

The frame portion 50 may include a standing portion 51, a base portion 53, a space providing portion 55, a footrest portion 57, and a rotating bar support portion 59.

The standing portion 51 may stand up from the bottom surface and provide a space where the load application portion 30 is accommodated.

The base portion 53 may extend forward from the lower end of the standing portion 51 and be seated on the bottom surface, and may provide a space where the main rotating axis 21 is mounted.

The standing portion 51 and the base portion 53 may form the shape of the Korean letter "ㄴ" so that the standing portion 51 may easily remain standing up.

The upper side of the space providing portion 55 may be connected to the standing portion 51, and the lower side thereof may be connected to the base portion 53, providing a space for the seating portion 10 to be mounted. In addition, the space providing portion 55 may be disposed at the rear of the seating portion 10 and may include a backrest portion 551 on which a user can lean back.

The backrest portion 551 may be mounted on the space providing portion 55 and formed in the form of a panel, so that a user sitting on the seating portion 10 can lean his or her back against the backrest portion 551 and rotate the rotating bar 20.

The footrest portion 57 may extend from the front end of the base portion 53 to provide a space for supporting feet of a user sitting on the seating portion 10.

The rotating bar support portion 59 may be connected to the base portion 53 and restrict rotation of the rotating bar 20 toward the standing portion 51.

The rotating bar 20 may include a first rotating bar 20*a* disposed on one side of the seating portion 10 and a second rotating bar 20*b* disposed on the other side thereof.

A user may grip a first grip portion 23 formed on the first rotating bar 20*a* with his or her left hand and grip a second grip portion 23 formed on the second rotating bar 20*b* with his or her right hand in order to work out by rotating the first rotating bar 20*a* and the second rotating bar 20*b*.

The variable load module 40 may include a first variable load module connected to the first rotating bar 20*a* and a second variable load module connected to the second rotating bar 20*b*.

The first variable load module and the second variable load module may be connected to the same load application portion 30.

Figure 3:
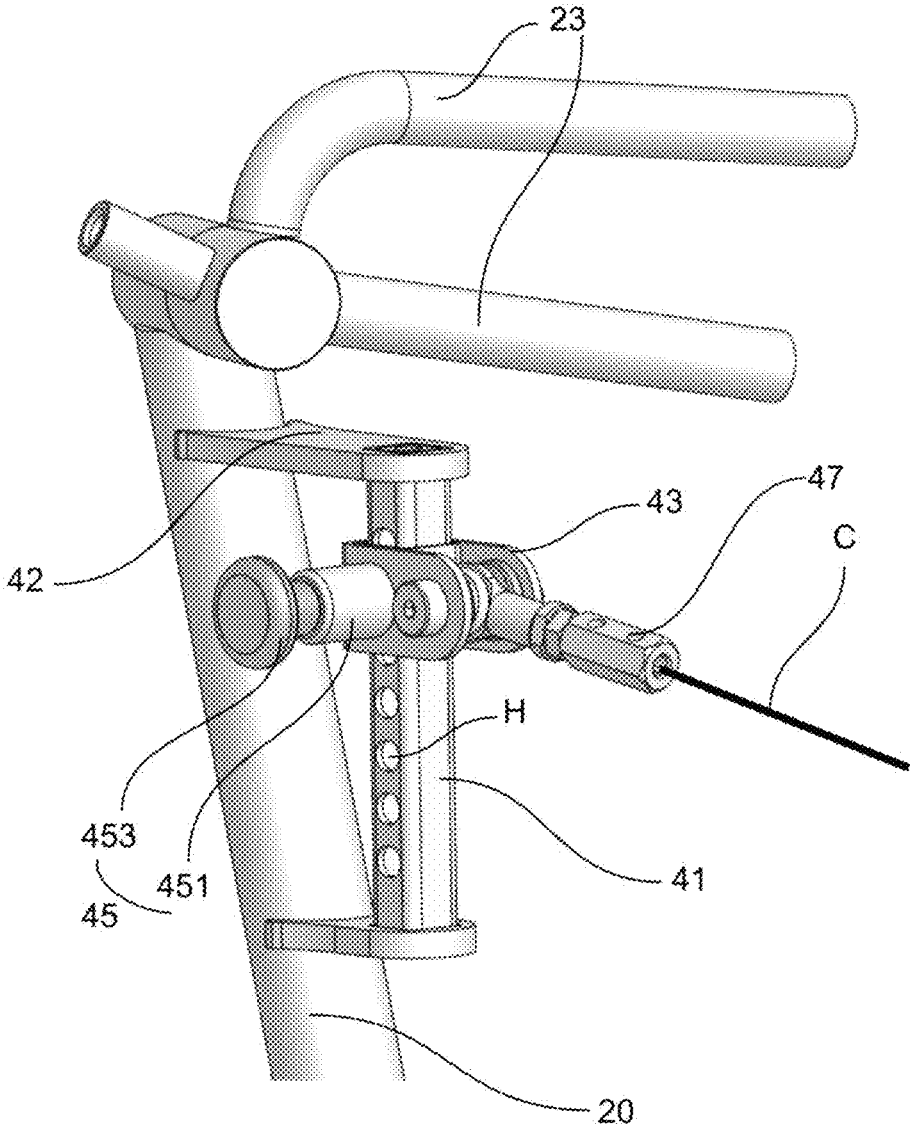
FIG. 3 is a perspective view schematically illustrating the variable load module of the exercise equipment with the variable load module according to an embodiment of the present disclosure.
Figure 4:
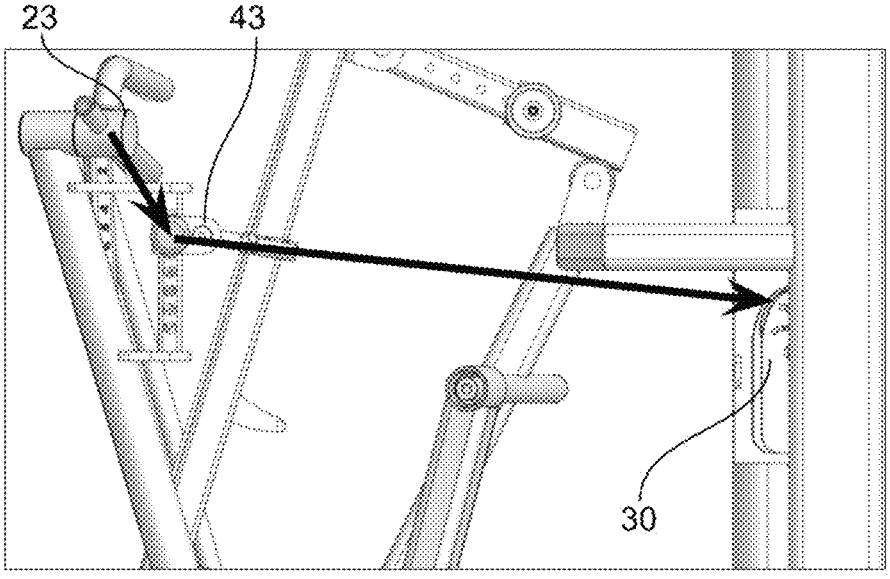
FIG. 4 is a view schematically illustrating the operation of the variable load module of the exercise equipment with the variable load module according to an embodiment of the present disclosure and the resulting effects.
Figure 4:
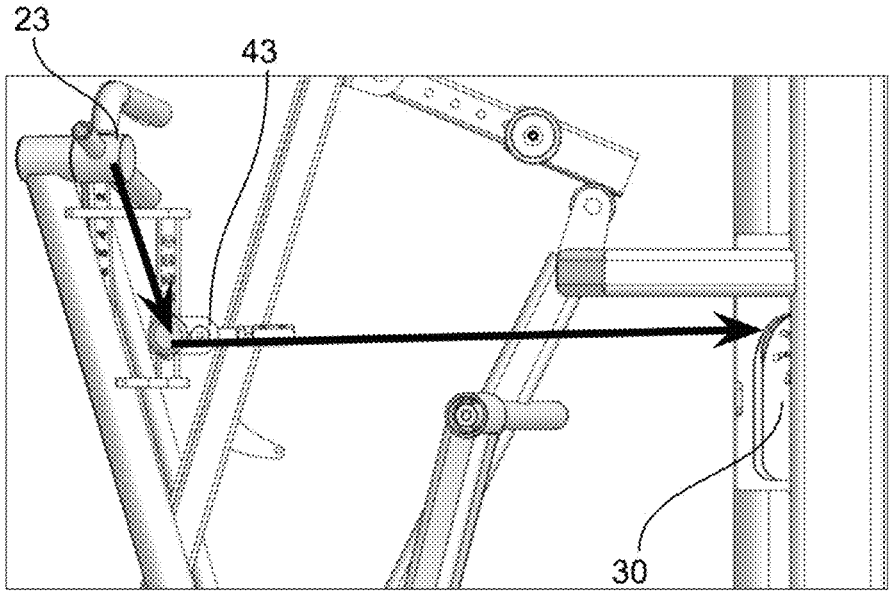
Figure 5:
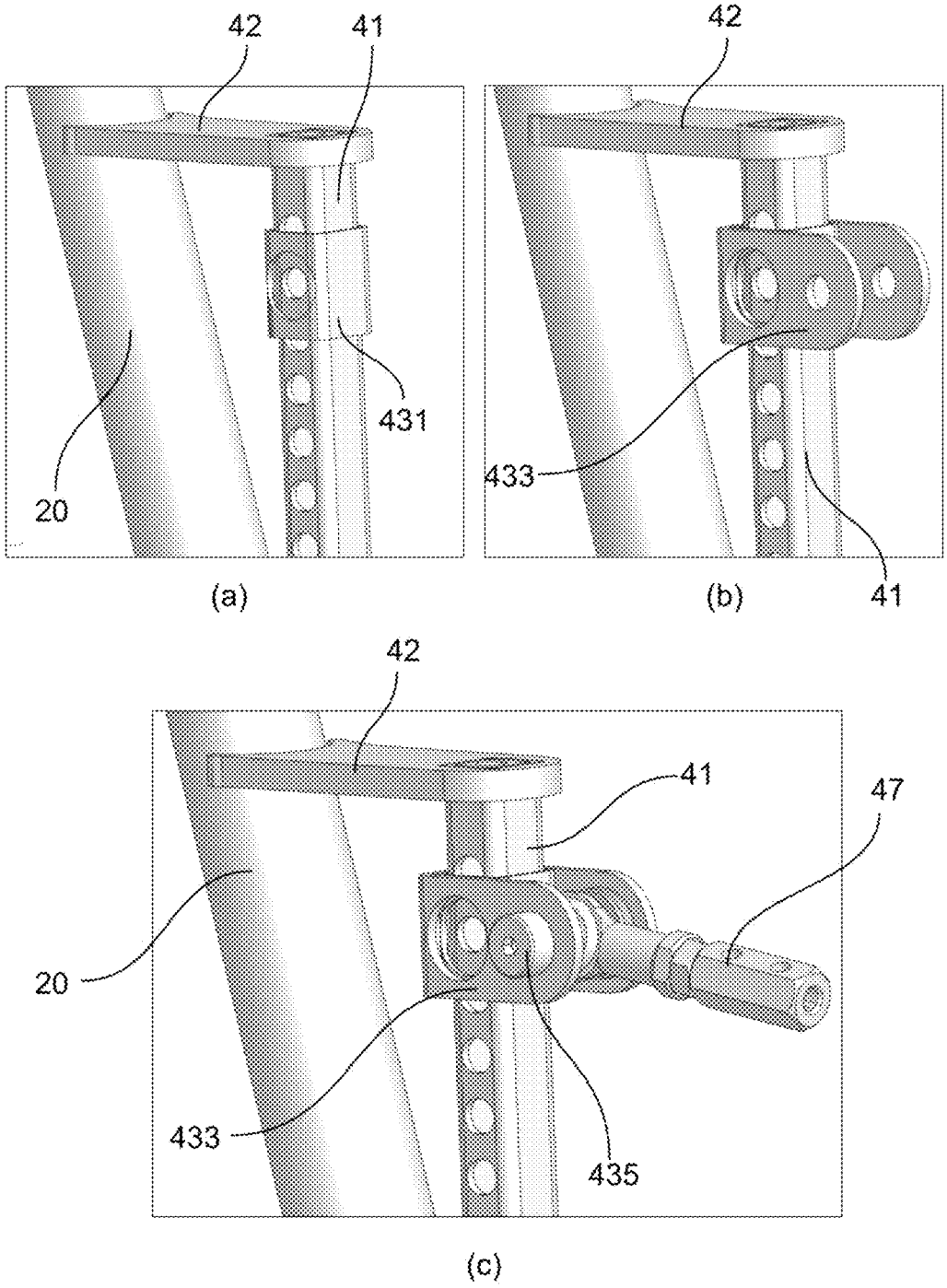
FIG. 5 is a view schematically illustrating the components of the variable load module of the exercise equipment with the variable load module according to an embodiment of the present disclosure.

FIG. 3 is a perspective view schematically illustrating the variable load module of the exercise equipment with the variable load module according to an embodiment of the present disclosure, FIG. 4 is a view schematically illustrating the operation of the variable load module of the exercise equipment with the variable load module according to an embodiment of the present disclosure and the resulting effects, and FIG. 5 is a view schematically illustrating the components of the variable load module of the exercise equipment with the variable load module according to an embodiment of the present disclosure.

Referring to FIGS. 3 to 5, the variable load module 40 of the exercise equipment 1 according to the present disclosure may include a mounting bar 41, a position moving portion 43, a fixing portion 45, a cable connection portion 47, and a mounting bar connection portion 42.

The mounting bar 41 may be formed on the rotating bar 20 and disposed adjacent to the grip portion 23, and may form a space for mounting in a height direction.

A scale may be formed on the mounting bar 41 in the height direction, and it may be possible for a user to determine the position of the position moving portion 43 through the scale.

The position moving portion 43 may be connected to the mounting bar 41 to slide in the height direction of the mounting bar 41.

Here, the height direction of the mounting bar 41 may be the direction in which the distance from the grip portion 23 changes.

The fixing portion 45 may be connected to the position moving portion 43, and may limit the sliding of the position moving portion 43 along the mounting bar 41 by being fastened to the mounting bar 41 or enable the position moving portion 43 to slide along the mounting bar 41 by being disengaged from the mounting bar 41. The fixing portion 45 may be a type of locking device that limits the positional movement by the position moving portion 43.

The cable connection portion 47 may be connected to the position moving portion 43 and the cable C. One side of the cable C may be connected to the load application portion 30, and the other side thereof may be fixed to the cable connection portion 47.

When the distance from the grip portion 23 increases, the position moving portion 43 may lengthen the vector path of a first external force applied to the grip portion 23 to raise and lower the load application portion 30, thereby increasing the intensity of the first external force. For reference, the minimum force for rotating the rotating bar 20 may be applied when the cable C has connected the grip portion 23 and the load application portion 30 in a straight line.

In addition, the intensity of the force for rotating the rotating bar 20 may vary depending on the direction and length of the distance between the position moving portion 43 and the grip portion 23.

Specifically, the intensity of the force for rotating the rotating bar 20 may relatively increase when the position moving portion 43 is moved away from the grip portion 23, because the distance increases as the deflection angle of the external force (the force exerted by a user pulling) applied to the grip portion 23 to pull the cable C increases (see figure (a) of FIG. 4).

Furthermore, the position moving portion 43 may shorten the vector path of a second external force applied to the grip portion 23 to raise and lower the load application portion 30 when the distance from the grip portion 23 decreases, thereby reducing the intensity of the second external force.

To be specific, the intensity of the force for rotating the rotating bar 20 may relatively decrease when the position moving portion 43 is moved closer to the grip portion 23, because the distance decreases as the deflection angle of the external force (the force exerted by a user pulling) applied to the grip portion 23 to pull the cable C decreases (see figure (b) of FIG. 4).

It may be possible for a user to obtain an exercise load caused by rotating the rotating bar 20 through the adjustment of the load application portion 30 or the positional movement by the position moving portion 43.

The mounting bar connection portion 42 may connect the mounting bar 41 and the rotating bar 20, and may be formed to be detachable from the rotating bar 20. It may be possible for a user to easily change the load through the variable load module 40 according to the present disclosure by attaching it to the rotating member of an existing exercise equipment 1.

The position moving portion 43 may include a sliding portion 431, an intermediate connection portion 433, and a connection rotation axis 435.

The sliding portion 431 may be in a shape corresponding to the outer peripheral surface of the mounting bar 41, surrounding the mounting bar 41.

The intermediate connection portion 433 may be fixed to the sliding portion 431 and interlocked with the sliding portion 431.

The intermediate connection portion 433 may be in the shape of the Korean letter "ㄷ," and the sliding portion 431 may be disposed in the inner space of the shape.

The connection rotation axis 435 may connect the intermediate connection portion 433 and the cable connection portion 47, and may be rotatably mounted on the intermediate connection portion 433, allowing the cable connection portion 47 to rotate against the intermediate connection portion 433.

When the intermediate connection portion 433 slides along the mounting bar 41, the connection rotation axis 435 may be rotated by the load from the load application portion 30, preventing the cable C from bending.

In addition, the connection rotation axis 435 may connect both ends of the intermediate connection portion 433, and may be arranged to be spaced apart from the sliding portion 431 to secure a space where the cable connection portion 47 can rotate.

Meanwhile, the mounting bar 41 may have a plurality of through holes H penetrating from one side thereof. The above-mentioned scale of the mounting bar 41 may be formed to correspond one-to-one with the plurality of through holes.

The fixing portion 45 may include a fixing body portion 451 and a fixing button portion 453.

The fixing body portion 451 may be fixed to the intermediate connection portion 433.

While the fixing button portion 453 is accommodated in the fixing body portion 451, the position of the fixing button portion 453 may be changed by an applied external force.

When the fixing button portion 453 is moved toward the mounting bar 41 by an applied external force, it may be inserted into any one of the plurality of through holes H, restricting the movement of the intermediate connection portion 433 on the mounting bar 41.

In addition, when the fixing button portion 453 is moved away from the mounting bar 41 by an applied external force, it may be separated from the through hole H into which it has been inserted, allowing the intermediate connection portion 433 to freely move on the mounting bar 41.

The components and features of the present disclosure have been described based on the embodiments of the present disclosure, but the present disclosure is not limited thereto. It is clear to a person having ordinary skill in the art that various changes or modifications can be made within the technology and scope of the present disclosure, so such changes or modifications fall within the appended claims.

The invention claimed is:

1. Exercise equipment with a variable load module, allowing a seated user to work out by pulling or pushing a rotating bar to lift a load and comprising:

a seating portion providing a space for a user to sit;

an external force application portion disposed adjacent to the seating portion and including the rotating bar that rotates about a main rotating axis and a grip portion that is formed on the rotating bar and provides a space for a user to grip;

a load application portion disposed at the rear of the seating portion, including a plurality of weights, and connected to the rotating bar with a cable to be raised and lowered according to the rotation of the rotating bar; and a variable load module connecting the rotating bar and the load application portion and allowing the position at which the cable is connected to the rotating bar to vary so that the load applied to the rotating bar changes; and wherein the variable load module includes:

a mounting bar formed on the rotating bar, disposed adjacent to the grip portion, and forming a space for mounting in a height direction;

a position moving portion connected to the mounting bar to slide in the height direction of the mounting bar;

a fixing portion connected to the position moving portion, which limits the sliding of the position moving portion along the mounting bar by being fastened to the mounting bar or enables the position moving portion to slide along the mounting bar by being disengaged from the mounting bar; and a cable connection portion connected to the position moving portion and the cable, when the distance from the grip portion increases, the position moving portion lengthens the vector path of a first external force applied to the grip portion to raise and lower the load application portion, thereby increasing the intensity of the first external force, and when the distance from the grip portion decreases, the position moving portion shortens the vector path of a second external force applied to the grip portion to raise and lower the load application portion, thereby reducing the intensity of the second external force.

2. The exercise equipment with the variable load module of claim 1, wherein the position moving portion includes:

a sliding portion that has a shape corresponding to the outer peripheral surface of the mounting bar and surrounds the mounting bar;

an intermediate connection portion fixed to and interlocked with the sliding portion; and a connection rotation axis connecting the intermediate connection portion and the cable connection portion and mounted rotatably on the intermediate connection portion to allow the cable connection portion to rotate against the intermediate connection portion, and when the intermediate connection portion slides along the mounting bar, the connection rotation axis is rotated by the load from the load application portion, preventing the cable from bending.

3. The exercise equipment with the variable load module of claim 2, wherein the intermediate connection portion is in the shape of the Korean letter "ㄷ", the connection rotation axis connects both ends of the intermediate connection portion and is arranged to be spaced apart from the sliding portion to secure a space where the cable connection portion can rotate, the mounting bar has a plurality of through holes penetrating from one side thereof, the fixing portion includes a fixing body portion fixed to the intermediate connection portion and a fixing button portion that is moved by an applied external force while it is accommodated in the fixing body portion, when the fixing button portion is moved toward the mounting bar by an applied external force, it is inserted into any one of the plurality of through holes, restricting the movement of the intermediate connection portion on the mounting bar, and when the fixing button portion is moved away from the mounting bar by an applied external force, it is separated from the through hole into which it has been inserted, allowing the intermediate connection portion to freely move on the mounting bar.

4. The exercise equipment with the variable load module of claim 1, further comprising:

a standing portion standing up from the bottom surface and providing a space where the load application portion is accommodated;

a base portion extending forward from the lower end of the standing portion to be seated on the bottom surface and providing a space where the main rotating axis is mounted;

a space providing portion connected to the base portion, providing a space for the seating portion to be mounted, disposed at the rear of the seating portion, and including a backrest portion on which a user can lean back; and a frame portion including a footrest portion that extends from the front end of the base portion to provide a space for supporting feet of a user sitting on the seating portion, the rotating bar includes a first rotating bar disposed on one side of the seating portion and a second rotating bar disposed on the other side thereof, and the variable load module includes a first variable load module connected to the first rotating bar and a second variable load module connected to the second rotating bar.

* * * * *